United States Patent [19]

Desplats

[11] 4,434,973

[45] Mar. 6, 1984

[54] ELECTRIC HOIST

[75] Inventor: André Desplats, Boulogne Billancourt, France

[73] Assignee: Tractel, S.A., France

[21] Appl. No.: 309,363

[22] Filed: Oct. 7, 1981

[30] Foreign Application Priority Data

Oct. 9, 1980 [FR] France ..... 80 21593

[51] Int. Cl.[3] ..... B66D 1/22; B66D 1/12; B66D 5/14

[52] U.S. Cl. ..... 254/344; 188/84; 254/362; 254/378

[58] Field of Search ..... 254/344, 356, 362, 363, 254/372, 378, 380, 382; 188/84

[56] References Cited

U.S. PATENT DOCUMENTS

| | | | |
|---|---|---|---|
| 1,323,245 | 12/1919 | Borkes | 254/344 |
| 3,042,375 | 7/1962 | Fahey et al. | 254/380 |
| 3,048,370 | 8/1962 | Kratzer | 254/380 |
| 3,323,779 | 6/1967 | Burnett | 254/344 |
| 3,524,626 | 8/1970 | Pomagalski et al. | 254/380 |
| 3,726,801 | 4/1973 | Sterner et al. | 254/344 |
| 3,876,184 | 4/1975 | Eudy | 254/356 |

*Primary Examiner*—Billy S. Taylor
*Attorney, Agent, or Firm*—William A. Drucker

[57] ABSTRACT

This electric hoist incorporates a wedging-groove pulley controlling a free-end wire-rope and comprises an epicyclic reducing gear surrounding the motor output shaft and providing a high reduction ratio with a minimum axial length; the gear comprises a sun wheel rigid with the motor shaft, planets meshing with this wheel and also with two internally toothed annuli having different tooth numbers, namely a fixed annulus and a driven annulus rigid with the wedging pulley coaxial with the motor shaft.

5 Claims, 2 Drawing Figures

37
35
4
5
11
8
10
16
12
15
17
18
14
13

ELECTRIC HOIST

BACKGROUND OF THE INVENTION

Field of the Invention

The present invention relates in general to electric hoists and has specific reference to an apparatus of this type comprising a wedging-grooved pulley for actuating a traction or hoisting wire rope having a free or loose end. Electric hoists of this type should desiredly be as compact and simple as possible while affording a high degree of safety in actual service and providing a high reduction ratio between the high speed motor shaft and the wedging grooved pulley, with a relatively reduced over-all axial length.

SUMMARY OF THE INVENTION

According to this invention, the desired above-defined result is obtained principally be directly associating the wedging grooved with a single-stage speed-reducer operating according to the principle known as "Ferguson's paradox", that is, a reducer comprising, disposed around an externally toothed sun wheel rigid with the motor output shaft (the high speed shaft), a planet carrier having several satellites meshing both with the sun wheel and with the internal teeth of both a fixed annulus and a movable driven annulus, the latter, according to the present invention, being rigid with the wedging grooved pulley mounted with the speed reducer within the hoist case at one end of the electric motor.

According to another feature of the present invention, the wedging grooved pulley revolves on a bearing fitted within the hoist case between the motor and the speed reducer, and the internally toothed annulus driven through the speed reducer is fastened to the pulley face adjacent the reducer, thus imparting a remarkable degree of balance to the hoist.

This invention is also characterised in that a brake consisting essentially of a friction disc interposed between two annular brake plates is mounted on the end of the high speed motor shaft which extends through the speed reducer, and that a freewheel device is so disposed between the friction disc and the motor shaft that the latter is rigid with the friction disc in only one sense of rotation. Advantageously, this freewheel device consists simply of a coil spring with contiguous turns engaging the shaft surface, one end of this spring being anchored to said friction disc. Thus, when the motor shaft rotates in the direction corresponding to the load-lifting hoisting operation—which is the spring uncoiling direction—the spring is expanded or loosened and the brake disc is no more driven by the shaft. In contrast thereto, when the motor shaft rotates in the opposite direction, it tends to contract the spring on the shaft, whereby the brake disc becomes rigid with the motor shaft which is thus braked and held against rotation when the motor is deenergized.

To facilitate the handling and operation of the electric hoist, the case enclosing the wedging groove pulley and having the electric motor mounted directly to one face thereof is provided in its upper portion with a handle rigid with means for suspending the hoist, the lower portion of the case being provided with an aperture permitting the free passage of both the free end and the taut or load end of the traction or hoisting wire rope passing over a considerable peripheral portion of the wedging groove of said pulley.

Moreover, at a location opposite the hoist handle, the motor is associated with a terminal box provided with a cover constituting a convenient base for laying the apparatus upon a surface when it is not suspended, this terminal box containing if desired the starting capacitor and relay together with the upper and lower limit switches and the control mechanism associated therewith, so that cable lengths necessary for wiring the motor control circuit as minimized.

In order to afford a clearer understanding of the invention, a preferred form of embodiment thereof will now be described with reference to the accompanying drawings.

THE DRAWINGS

FIG. 1 is a side view of the electric hoist, the upper half being shown in radial section, and FIG. 2 is a cross sectional view taken on the median plane of the wedging grooved pulley.

DESCRIPTION OF THE PREFERRED EMBODIMENT

Figure 1:
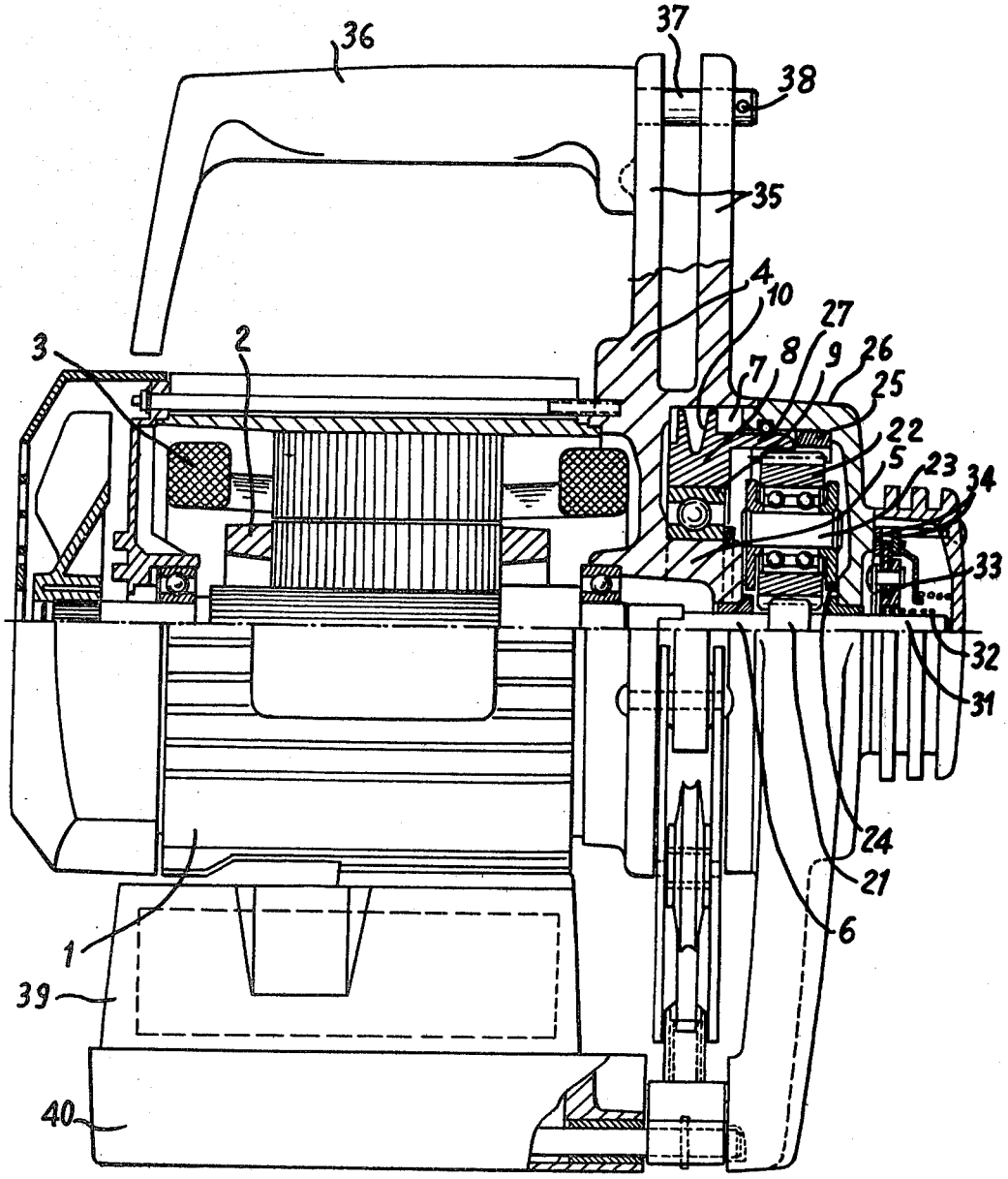
Figure 2:
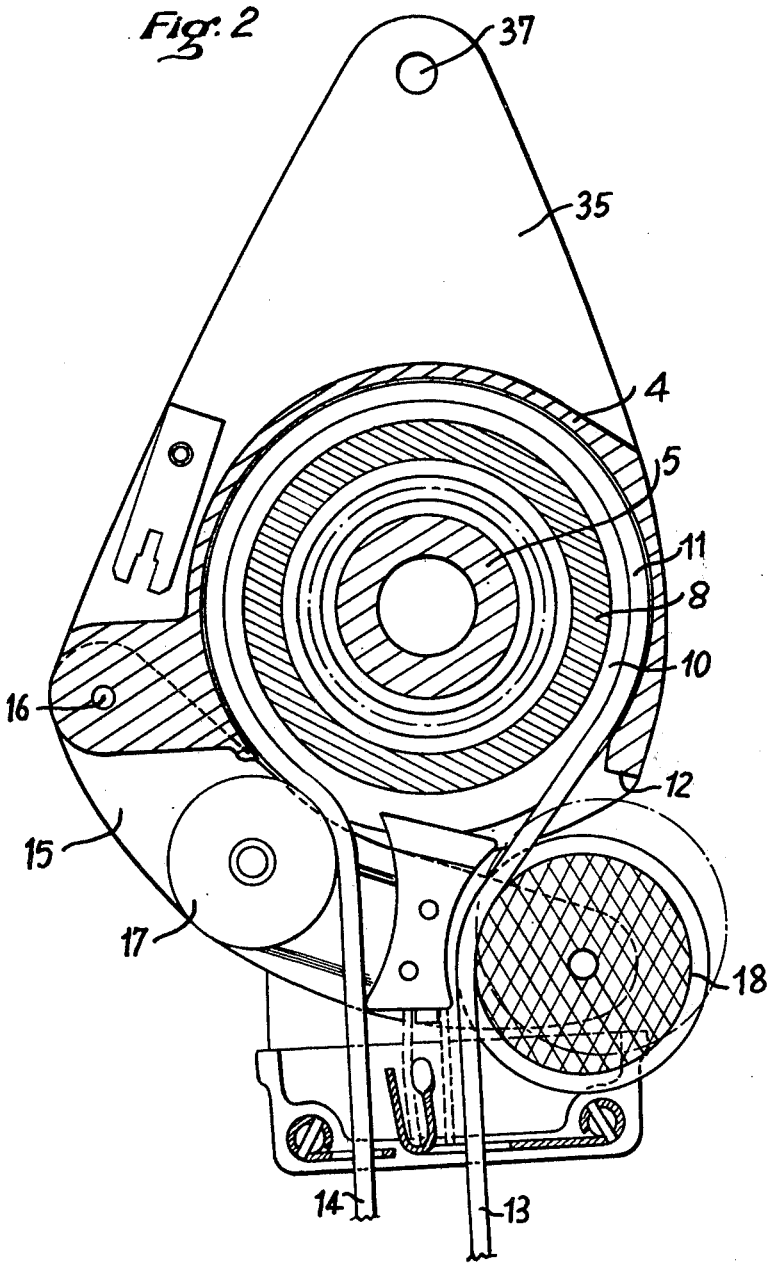

In the example illustrated in the drawings the electric motor 1 comprising a rotor 2 and a stator 3 is secured directly to one face of the hoist case 4, the output shaft 6 of this motor projecting through a reinforced and apertured portion 5 of said case 4. The case face opposite said motor has formed therein a recess 7 surrounding said reinforced portion 5 and having fitted therein a ball-bearing 9 for the wedging pulley 8. This pulley has a V-groove 10 adapted to receive the hoisting or traction wire rope 11 (FIG. 2). An aperture 12 is formed in the bottom portion of case 4 surrounding said recess 7 to permit the passage of the two rope ends, namely the taut or loaded rope end 13 and the slack or free rope end 14. These two rope ends 13, 14 are movable between the two side walls of an arm 15 fulcrumed to the case 4 about a pivot pin 16; this arm 15 carries on either side of the rope ends 13, 14 on the one hand a presser roller 17 adjacent said pin 16 which engages the free or loose end 14 of the wire rope, and on the other hand a grooved driven pulley 18 so that the loaded or taut end 13 of the wire rope engages one portion of the periphery of this pulley 18, whereby the load supported by said end 13 will constantly urge the driven pulley 18 to raise the arm 15 and cause the roller 17 to press the rope end 14 into the bottom of the V groove 10 of wedging pulley 8. It is clear that with this arrangement the pressure exerted by the presser roller 17 increases with the load supported by the taut end 13 of the wire rope.

According to a specific feature characterising this invention, the wedging grooved pulley 8 is associated with an epicyclic reduction gear of the type utilizing the well-known Ferguson's paradox, i.e. comprising a planet cage or carrier of which the satellites mesh both with the external teeth of a sun wheel carried by the high speed shaft 6 and with two sets of internal teeth carried by a fixed annulus 25 and a driven annulus 27 rigid with pulley 8, respectively the numbers of teeth of the two sets differring only very slightly. Thus, the sun gear 21 will mesh with two planet wheels 22 rotatably mounted by means of pins 23 in a revolving cage 24. Each planet meshes both with the inner teeth of a fixed annulus 25 carried by an end portion 26 of case 4 and with the inner teeth of the driven annulus 27 rigid with pulley 8.

Thus, though both toothed annuli 25, 27 are coaxial and mesh with the same planet gears 22, their pitch-circles and tooth numbers differ slightly and, according to Ferguson's paradox, the meshing is made possible by the different cutting of the teeth of annuli 25, 27 and by a suitable cutting of the plant gears 22. By way of example, assuming that the tooth numbers N1, N2, N3, N4 of gears 21, 22, 25 and 27 are 8, 22, 56 and 54, respectively, and that in this case the reduction ratio, i.e. the ratio of the angular velocity of sun wheel 21 to the angular velocity of the teeth of annulus 27 is $$\frac{N4(N3 + N1)}{N1(N4 - N3)},$$

$$\text{i.e. } \frac{54 \times (56 + 8)}{8 \times (54 - 56)} \text{ or } \frac{54 \times 64}{(-16)} = -216.$$

In other words, the wedging pulley 8 rotates in a direction opposite that of motor shaft 6 and at a velocity reduced 216 times. It will thus be seen that with a single epicyclic reducing stage a very high reduction ratio is obtained by using a mechanism of extremely reduced axial length.

According to a particularly advantageous arrangement, the wedging pulley 8 is housed between the electric motor and the speed reducer, thus warranting a satisfactory balance of the electric hoist assembly.

The relatively high reduction ratio (1:216) obtained by using the above-described reducer is such that the reducer itself is hardly reversible, and this property is particularly useful in an apparatus intended for lifting loads, while permitting the use of a simple brake since the torque applied thereto is extremely low. With this high reduction ratio, the load supported by the wire rope cannot cause the hoist to heave back when the motor is stopped in the load-hoisting direction. On the other hand, if the motor were stopped when allowing the load to move down, the risk of a slow continuation of this downward movement as a consequence of gravity is extremely moderate. However, to positively avoid, minimize or eliminate this risk, the brake acting on shaft 6 is operative in only one direction of rotation. For this purpose, the shaft 6 is provided at its outer end with a cylindrical portion 31 having coiled thereon a spring wire 32 having contiguous turns and one end anchored to a friction disc 33 inserted between two annular brake plates 34 resiliently clamped on either side of said friction disc. The coil spring 32 is mounted in such a way that when the motor shaft 6 rotates in the direction corresponding to a load lifting operation, it tends to uncoil the spring and thus release the tightening force exerted by this spring on the shaft, so that the friction disc 33 is not carried along by the shaft. In contrast thereto, when the shaft 6 rotates in the load-lowering sense it increases the tightening force exerted by the spring on the shaft surface, so that the shaft-driven brake disc 33 is braked by the annular plates 34 between which it is clamped.

The case 4 may advantageously comprise an upper extension in the form of a pair of parallel flanges 35 to which a handle 36 is mounted, this handle 36 comprising an anchoring pin 37 extending through the flanges 35 and locked thereto by means of a diametral resilient pin 38.

The reference numeral 39 designates a downward-facing cable terminal box opposite the handle 36. This box may contain the starting capacitor and relay, together with the limit switches for controlling the upward and downward strokes of the wire rope. The terminal box is closed by a special cover 40 adapted to act when necessary as a very stable and convenient base plate for laying the apparatus upon a flat surface when the electric hoist is not suspended by means of the pin 37.

It will be readily understood by those conversant with the art that the specific, single and preferred form of embodiment of the invention which is described hereinabove with reference to the accompanying drawing is given by way of example, not of limitation, and that many modifications and changes may be brought thereto without departing from the basic principles of the invention as set forth in the appended claims.

What I claim is:

1. An electric hoist comprising:

a case within which an electric motor is disposed, said motor presenting an output shaft passing through said case, a reduction gear providing a high speed reduction ratio with a reduced overall axial length, which comprises:

a sun wheel carried by said motor output shaft, a planet gears carrying cage disposed within an extension of the case, planet gears carried on bearings on said cage and meshing with said sun wheel, a fixed first annulus rigid with the case and coaxial with the motor output shaft, said first annulus presenting internal teeth meshing with said planet gears, a second annulus coaxial with the motor output shaft, meshing with said planet gears and of which the number of teeth is slightly different from the tooth number of said first annulus, a wedging groove pulley for actuating a free-end traction or hoisting wire rope, said pulley being disposed in a space provided within the case, between said motor and said reduction gear, and being carried by a reinforced element coaxially with the motor output shaft, flanges extending upwardly from said case and presenting openings for securing an anchoring pin, and an upper handle rigid with said anchoring pin.

2. The electric hoist of claim 1 wherein the motor output shaft has mounted thereon a brake operating only when said shaft rotates in a load lowering direction.

3. The electric hoist of claim 2 wherein said brake operating only when the motor shaft rotates in a load lowering direction consists of a friction disc clamped between two annular non-rotating plates, said disc being rigid with one end of a coil spring having contiguous turns wound on the outer peripheral surface of the motor shaft in the direction to cause the spring to be loosened from the shaft when the shaft rotates in a load-lifting direction.

4. The electric hoist of claim 1 wherein said wedging-groove pulley rotates within a case comprising, opposite said upper handle, a lower aperture through which the taut end and the free end of the wire rope are caused to extend, the taut end passing over one fraction of a driving grooved pulley adapted to control the wedging action and journaled on a pin carried by a pivoting lever also supporting between said pin and said control pulley a presser roller engaging the free end of the wire rope and pressing said wire rope into the groove of said wedging grooved pulley with a force increasing with the load carried by said taut end of the wire rope.

5. The electric hoist of claim 1 wherein said motor case comprises, opposite said upper handle, a downwardly-facing terminal box provided with a flat-bottomed cover whereby the apparatus can conveniently be laid upon a flat surface in order to improve the stability of the hoist when the hoist is not suspended by means of said handle.

* * * * *